US007490408B2

(12) United States Patent
Eichhorn et al.

(10) Patent No.: US 7,490,408 B2
(45) Date of Patent: Feb. 17, 2009

(54) ELECTRIC SHAVING APPARATUS

(75) Inventors: Reinhold Eichhorn, Idstein (DE); Detlef Gleich, Friedrichsdorf (DE); Sebastian Hottenrott, Idstein (DE); Peter Junk, Seelenberg (DE); Christof Kleemann, Eschborn (DE); Michael Odemer, Niddatal-Assenheim (DE); Thorsten Pohl, Mühlheim (DE); Tobias Schwarz, Schmitten (DE); Jürgen Wolf, Kriftel (DE)

(73) Assignee: Braun GmbH, Krongberg (DE)

( * ) Notice: Subject to any disclaimer, the term of this patent is extended or adjusted under 35 U.S.C. 154(b) by 32 days.

(21) Appl. No.: 11/639,648

(22) Filed: Dec. 15, 2006

(65) Prior Publication Data

US 2007/0130774 A1 Jun. 14, 2007

Related U.S. Application Data

(63) Continuation of application No. PCT/EP2005/006239, filed on Jun. 10, 2005.

(30) Foreign Application Priority Data

Jun. 17, 2004 (DE) ..... 10 2004 029 234

(51) Int. Cl.
*B26B 19/10* (2006.01)

(52) U.S. Cl. ..... 30/34.1; 30/43.92

(58) Field of Classification Search ..... 30/34.05, 30/34.1, 43.7, 43.8, 43.9, 43.91, 43.92
See application file for complete search history.

(56) References Cited

U.S. PATENT DOCUMENTS

| | | | | | |
|---|---|---|---|---|---|
| 2,917,824 | A | * | 12/1959 | Brauss | 30/34.1 |
| 3,690,000 | A | | 9/1972 | Loner | |
| 3,780,434 | A | * | 12/1973 | de Boer et al. | 30/34.1 |
| 3,781,990 | A | * | 1/1974 | Loner | 30/34.1 |
| 3,905,099 | A | * | 9/1975 | Bernstrom | 30/41.5 |
| 4,050,151 | A | | 9/1977 | de Boer et al. | |
| 4,283,848 | A | * | 8/1981 | Messinger et al. | 30/34.1 |
| 4,505,036 | A | * | 3/1985 | Ochiai et al. | 30/34.1 |
| 4,845,847 | A | * | 7/1989 | Yasunaka et al. | 30/34.1 |
| 4,930,217 | A | * | 6/1990 | Wolf et al. | 30/43.92 |
| 4,941,259 | A | * | 7/1990 | Wolf | 30/34.1 |
| 5,054,199 | A | | 10/1991 | Ogawa et al. | |
| 5,289,636 | A | * | 3/1994 | Eichhorn et al. | 30/43.92 |
| 5,507,095 | A | * | 4/1996 | Wetzel et al. | 30/34.1 |
| 5,524,345 | A | * | 6/1996 | Eichhorn | 30/34.1 |
| 5,701,673 | A | * | 12/1997 | Ullmann et al. | 30/34.1 |
| 2002/0078570 | A1 | | 6/2002 | Andrew | |

FOREIGN PATENT DOCUMENTS

| | | |
|---|---|---|
| DE | 37 29 257 | 3/1989 |
| DE | 195 31 013 | 10/1996 |

* cited by examiner

*Primary Examiner*—Hwei-Siu C Payer
(74) *Attorney, Agent, or Firm*—Fish & Richardson P.C.

(57) ABSTRACT

An electric-powered shaving apparatus with a drive part excitable by an electric motor into performing an oscillatory motion, the drive part transmitting its motion for cutting hairs to a short-hair cutter and to a long-hair trimmer. The long-hair trimmer is displaceable relative to the housing into an advanced and a retracted position. The motion of the drive part for the short-hair cutter is utilized for moving the long-hair trimmer into the advanced position.

8 Claims, 5 Drawing Sheets

ELECTRIC SHAVING APPARATUS

CROSS REFERENCE TO RELATED APPLICATIONS

This application is a continuation of PCT application serial number PCT/EP2005/006239, filed Jun. 10, 2005, which claims priority under 35 U.S.C. §119 (a) from German application serial number DE 10 2004 029 234.5, filed Jun. 17, 2004, the entire contents of both of which are hereby incorporated by reference.

TECHNICAL FIELD

This document relates to an electric shaving apparatus.

BACKGROUND

An electric-powered shaving apparatus having an undercutter reciprocating underneath a shaving foil is known from German Patent No. DE 195 31 013 C 1. In this shaving apparatus, which shaves either with or without moisture, the short-hair cutter unit is driven by a first electric motor. To pop up the long-hair trimmer unit, this shaving apparatus uses another electric motor with a gearing. This motor, upon being turned on, drives the gearing, thereby moving the long-hair trimmer from its home position into its advanced position. Since movement of the long-hair trimmer is effected just by touching an electric switch, this arrangement presents a comfortable handling solution for an electric shaving apparatus.

SUMMARY

One aspect of the present invention is an electric-powered shaving apparatus having a drive part excitable by an electric motor into performing an oscillatory motion. The drive part transmits its motion for cutting hairs to a short-hair cutter on the one hand and to a long-hair trimmer on the other hand. The long-hair trimmer is displaceable relative to the housing into an advanced and a retracted position, utilizing the motion of the drive part for moving the long-hair trimmer into the advanced position. The shaving apparatus has a cutter block that is adapted to reciprocate along a shaving foil and that is driven by the oscillatory motion of the drive part connected to the an electric motor, the shaving apparatus makes use of this particular motion for driving a long-hair trimmer integrated in the shaving apparatus. Therefore, there is no need to provide an additional drive motor for popping up the long-hair trimmer.

The coupling of the pop-up device of the long-hair trimmer to the drive part of the shaving apparatus can be accomplished either within the housing or, in some embodiments, on the portion protruding from the housing, which conventionally is part of an oscillatory bridge. In the latter embodiment, an additional sealing is avoided because both the coupling of the pop-up device to the oscillatory drive part and the long-hair trimmer itself are generally arranged outside the housing of the shaving apparatus.

For moving the long-hair trimmer into the advanced position, a motion-converting mechanism is provided between the drive part and the long-hair trimmer to divert the oscillatory motion into the direction of displacement (X) of the long-hair trimmer. The oscillatory motion of the drive part is converted in the motion-converting mechanism into an equally oscillatory motion which takes place in the direction of displacement of the long-hair trimmer. Typically, the oscillatory motion of the drive part takes place in the same direction as the motion of the cutter block of the short-hair cutter and as the motion of the undercutter of the long-hair trimmer. Considering that displacement of the long-hair trimmer into its advanced position is precisely perpendicular to the oscillatory motion of the drive part, it is necessary to divert this motion into this direction by means of a motion-converting mechanism. It is only then that this motion can be transferred to the long-hair trimmer to effect its displacement.

At the output of the motion-converting mechanism, provision is made for a strip movable in the direction of displacement (X). A first ratchet-and-pawl mechanism is provided between the strip and the long-hair trimmer. The first ratchet-and-pawl mechanism has a movable pawl on the long-hair trimmer and a toothed construction on the strip. The toothed construction is movable into meshing engagement with the pawl for advancing the long-hair trimmer. This establishes a connection between the output of the motion-converting mechanism and the long-hair trimmer by selecting a releasable engagement device in the form of the pawl provided on the long-hair trimmer and the toothed construction provided on the output for locking engagement by the pawl when the long-hair trimmer is engaged, the pawl thereby taking along the long-hair trimmer, step by step, to its advanced position in accordance with the converted oscillatory motion. The taking along in steps is attributable to the fact that, owing to the oscillatory motion, only a small oscillatory motion in the diverted direction of projection of the long-hair trimmer takes place, while movement in the opposite direction is not transmitted to the long-hair trimmer because of slippage, as in a ratchet. Equivalent solutions are also applicable, for example the pawl and the toothed construction can be interchanged.

Since the oscillatory motions in electric-powered dry shavers are relatively high in order to obtain a good cutting result, the movement of the long-hair trimmer to its end position is also fast. This can be further enhanced, in some embodiments, by selecting a correspondingly high transmission ratio in the motion-converting mechanism. The engagement of the pawl with the toothed construction at the output of the motion-converting mechanism can take place either mechanically by hand, or electrically by means of a solenoid-operated switch or similar devices.

Following latching engagement of the pawl with the toothed construction, a retaining device is provided that permits release of the first ratchet-and-pawl mechanism only when the long-hair trimmer is in the maximum advanced position. This means that when the ratchet-and-pawl mechanism is engaged mechanically, with the shaver turned on and the long-hair trimmer in the home position, it continues to be engaged until the long-hair trimmer has reached its maximum position. Only in the maximum advanced position of the long-hair trimmer can the pawl disengage itself from the toothed construction at the output. A guide rib for the pawl is interrupted at the upper stop, enabling an accurate position of the long-hair trimmer. On completion of the shaving operation, the long-hair trimmer can be pushed back to its home position by releasing the retaining elements.

In some embodiments, the retaining elements have a rib-and-groove arrangement extending in the direction of displacement of the long-hair trimmer. In this arrangement, the rib may be formed either on the pawl or on the housing of the shaving apparatus. Correspondingly, the groove is then provided on the respective other part. A dovetail guideway, or similar guiding devices, can also be used.

A second ratchet-and-pawl mechanism acts between the long-hair trimmer and the housing of the shaving apparatus, and the second ratchet-and-pawl mechanism inhibits displacement of the long-hair trimmer in the direction opposite the pop-up direction, ensuring a secure seat of the long-hair trimmer after it has reached its maximum advanced position. The second ratchet-and-pawl mechanism acts as a retaining device to prevent displacement of the long-hair trimmer towards its home position. The long-hair trimmer is only released when this second ratchet-and-pawl mechanism is disengaged mechanically by hand or by electrical devices.

The second ratchet-and-pawl mechanism has of a lever fastened to the housing and resiliently engaging in a longitudinal toothed construction provided on the long-hair trimmer. In some embodiments, a detent lever cooperating with a toothed construction can been used as second ratchet-and-pawl mechanism, with the detent lever being mounted for rotation on the housing and resiliently engaging the toothed construction formed on the long-hair trimmer, so as to inhibit movement of the long-hair trimmer in the direction of its home position. Only after the detent lever of the second ratchet-and-pawl mechanism is mechanically unlatched from the toothed construction is it possible for the long-hair trimmer to be shifted back to its home position.

In some embodiments, the long-hair trimmer is biased against the pop-up direction by a spring element. The long-hair trimmer is automatically returned to its home position by the force of the spring following unlatching of the second ratchet-and-pawl mechanism.

The first and the second ratchet-and-pawl mechanism are adapted to latch and unlatch manually by means of a control element. This results in a simple mechanical latching/unlatching arrangement which is actuatable by hand. A particularly low-cost arrangement can be achieved with a tandem lever which, on being turned in the one direction, causes the first ratchet-and-pawl mechanism to be latched and, on being turned in the other direction, causes the second ratchet-and-pawl mechanism to be unlatched.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

Figure 1:
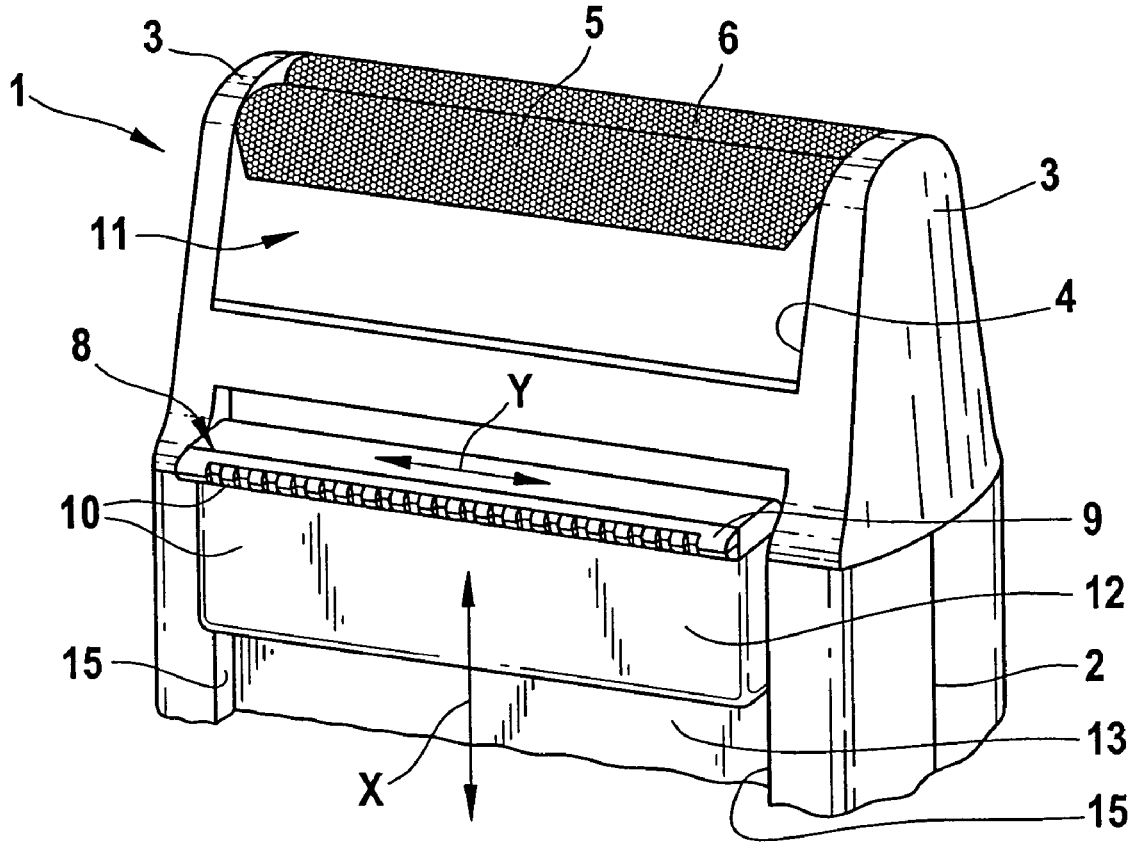
FIG. 1 is a fragmentary perspective view of the upper part of an electric-powered shaving apparatus having a short-hair cutter and a long-hair trimmer unit, with the long-hair trimmer being shown in its home position.

FIG. 1 shows an electric-powered shaving apparatus 1 conventionally designated as a dry shaver, having a housing 2 and a shaving head 3 adjoining the upper part of the housing 2. The shaving head 3 may be fixedly or pivotally mounted in the housing 2 and it has an upwardly open aperture 4 with two upwardly arched shaving foils 5, 6 integrated therein. The undersurface of the two shaving foils 5, 6 is engaged by two cutter blocks (not shown) arranged side-by-side and connected with each other, which are excitable by a drive part 22, as shown in FIGS. 2 to 5, into performing an oscillatory, that is, reciprocating motion Y. In some embodiments, the drive part 22 is connected to a rotary electric motor (not shown) received in the housing 2 through an eccentric gearing (not illustrated in the drawing). For generation of the oscillatory motion, an oscillating armature motor or some other electric drive can be used.

Figure 2:
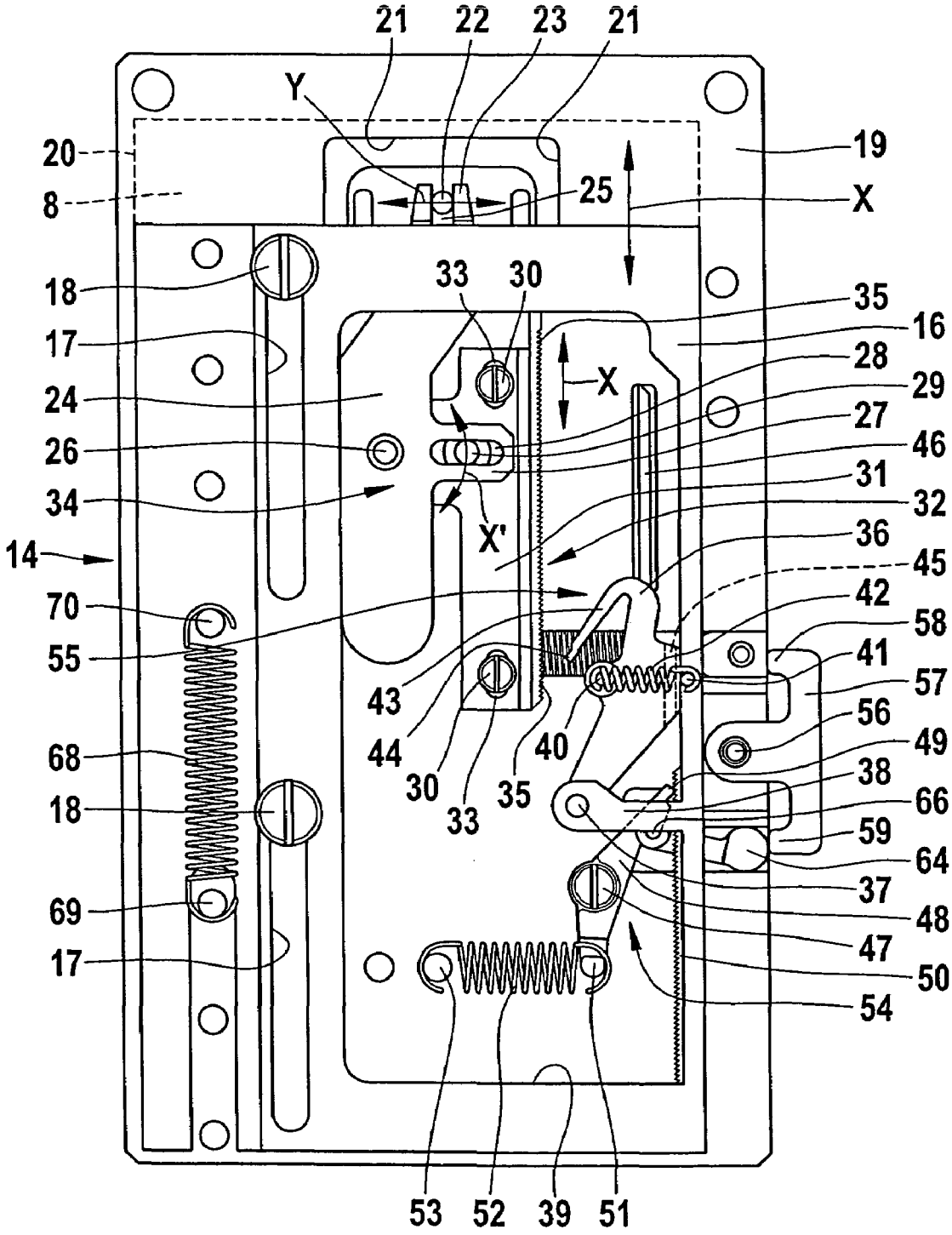
FIG. 2 is a part of an interior view showing an embodiment of a mechanical actuating device for a long-hair trimmer, with the mechanical actuating device being arranged in the housing of the shaving apparatus on the same side as the long-hair trimmer.
Figure 3:
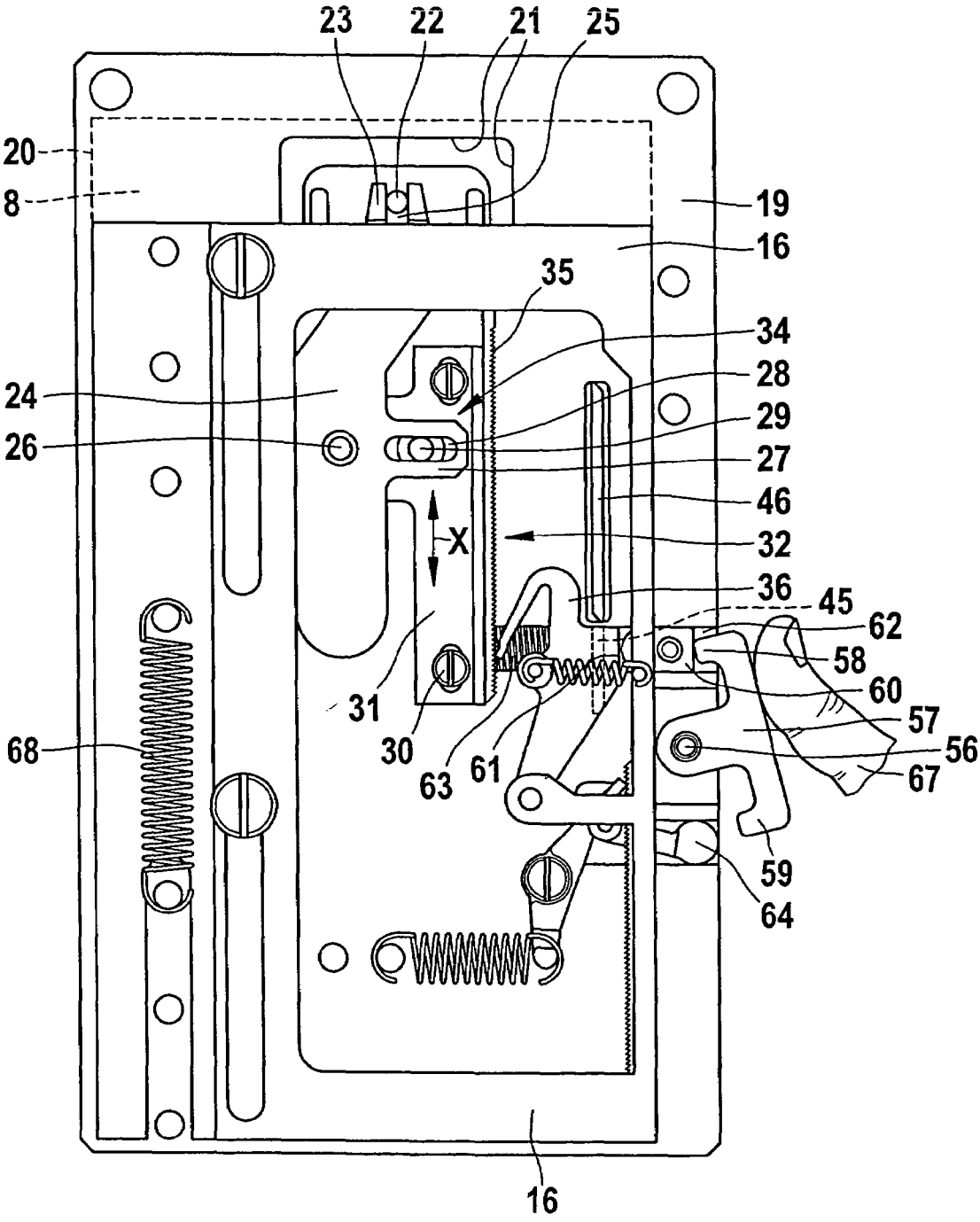
FIG. 3 is a view of the mechanical actuating device of FIG. 2, in which however the first ratchet-and-pawl mechanism was brought into engagement by means of the tandem lever for displacement of the long-hair trimmer.

Provided on the front side of the housing 2 in FIG. 1 is a long-hair trimmer 8, which has a stationary outer cutter 9 and an undercutter 10 slidably engaging the undersurface of the outer cutter 9, and performing reciprocating motions in the direction Y when in operation. The long-hair trimmer 8 combines with its front panel 12 and with the mechanical pop-up device 14, disposed behind the front wall 13 (FIG. 1) and as schematically shown in FIGS. 2 to 5, to form the long-hair trimmer unit. In FIG. 1 the long-hair trimmer 8 is guided on its sides in opposite lying lateral grooves 15 for up and down movement in the direction X, as shown in FIGS. 1, 2 and 3.

FIGS. 2 to 5 show an embodiment of pop-up device 14 reflecting the basic structure of the pop-up device 14. Thus, in the embodiment shown in FIGS. 2 through 5, the housing 2 has flanged to it a provisional backing plate 19. Two guide pins 18 are fixedly secured to the provisional backing plate 19, vertically one above the other in the direction of displacement X of the long-hair trimmer 8. The pins extend through respective longitudinal slots 17. The slots 17 are formed in a support slide 16 equally in the direction of displacement of the long-hair trimmer 8 for relative sliding movement with snug lateral fit. As a result, the support slide 16 is guided in the longitudinal slots 17 only in the up and down direction of displacement X. In other embodiments, other guide arrangements 17, 18 may be substituted for the guide arrangement shown, including for example a dovetail, a coulisse, a rail, a drawer guideway etc., provided that the direction of displacement X, which is perpendicular to the orientation of the outer cutter 9 and undercutter 10 and also perpendicular to the movement Y of the undercutter 10, of the long-hair trimmer 8 is accurately maintained, and that the support slide 16 moves also parallel to the housing 2.

Secured to the support slide 16 is the long-hair trimmer 8, as indicated in FIGS. 2 to 5 by the broken line 20. In some embodiments, the support slide 16 and the long-hair trimmer 8 can be combined into a single plastic component. At this point it is further noted that like components shown in FIGS. 2 to 5 are assigned like reference characters even if not expressly referred to in each Figure, accordingly also functioning in like manner.

Formed in the backing plate 19, in FIGS. 2 to 5, is a substantially rectangular cutout 21 into which the drive part 22, which is connected with an electric motor (not shown), extends from the interior of the housing 2. The drive part is connected to a bell crank lever 24 through a claw coupling 23 provided on the lever. The claw coupling 23 is of a substantially fork-shaped configuration having a slot 25, which is engaged by the drive part 22 constructed as a peg. Through a journal 26 secured to the backing plate 19, the bell crank lever 24 is mounted for pivotal movement about the journal in the range of the oscillatory motion Y. The bell crank lever 24 is arranged in front of the backing plate 19.

Level with the journal 26, and on its right-hand side when viewing FIGS. 2 to 5, an angle member 27 extends away from the bell crank lever 24. The angle member has a horizontally extending longitudinal bore 28 engaged by a roll-type driving element 29, which in turn is fixedly connected with a strip 31 secured to the backing plate 19 by screws 30. The strip 31 extends in the direction of displacement X, and has on its right-hand side a toothed construction 32 running along the strip 31 from below to above. Above and below the angle member 27, the strip 31 is provided with slots 33 penetrated by screws 30 sized to fit snugly laterally, thereby producing a slide guide for the strip 31 in the direction X. Both the guide pins 18 and the screws 30 have their ends enlarged to maintain the parts 16, 31 at a constant distance parallel to the housing 2. The bell crank lever 24 and the strip 31 provide a motion-converting mechanism 34 which translates the horizontal reciprocating motion in the direction Y to a vertical up-and-down motion in the direction X.

According to FIGS. 2 to 5, the toothed construction 32 is composed of a plurality of slightly upwardly slanting small teeth 35 disposed one above the other along the same line, their relative spacing being dimensioned so small that on each forward stroke of the strip 31 in the direction X at least one tooth can be skipped, hence feeding the strip 31 upwardly in the direction X.

According to FIGS. 2 to 5, rotatably mounted on the support slide 16 at a site level with the lower section of the toothed construction 32 is a hook-shaped pawl 36, having its center of rotation 37 located on a projection 38 formed on the support slide 16. The support slide 16 is essentially frame-shaped and has a quadrangular aperture 39 extending substantially parallel to the edge of the support slide 16. In FIGS. 2 to 5, the center of rotation 37 of the pawl 36 lies to the right of the toothed construction 32 and below it on the support slide 16. The pawl 36 and the support slide 16 have each a respective fastening lug 40, 41 between which a biased extension spring 42 is held which ensures that the pawl 36 is turned clockwise about its center of rotation 37. In the home position of FIGS. 2, 4 and 5, it abuts against the support slide 16 or the intermediate member 60.

The pawl 36 has an angled arm 43, whose free end 44 is designed for engagement with each individual tooth 35 from above, hooking into it on upward movement of the strip 31 (FIG. 3) such that the pawl 36 takes along the support slide 16 upwardly in the direction X. Provided on the side of the pawl 36 facing the backing plate 19 is a rib 45 extending in the direction X. The rib protrudes from the rear end of the pawl 36, and is shown in broken lines in FIGS. 2 to 5, since it is not visible from the front. The rib 45 corresponds with a groove 46 formed in the backing plate 19, that is, the groove 46 is in alignment with the rib only when the pawl 36 has reached the position shown in FIG. 3. In this position the pawl 36 connected with the support slide 16 is able to engage the groove 46 in its upward movement, so that the pawl 36 dwells in this position shown in FIG. 3 while the upward movement continues, its tooth 44 hence resiliently engaging a tooth 35 on the toothed construction 32.

The pawl 36 and the toothed strip 31 combine to form the first ratchet-and-pawl mechanism 55. In the direction of upward movement X of the support slide 16, the first ratchet-and-pawl mechanism 55 takes along the pawl and with it the long-hair trimmer 8 connected to the support slide 16. In the direction of downward movement X, the first ratchet-and-pawl mechanism 55 slides over the teeth 35 owing to the resilient arm 43, without taking along the support slide in downward direction, provided that the second ratchet-and-pawl mechanism 54 is in engagement. Explained in greater detail in the following description. The groove 46 extends likewise in the direction of displacement X, with the upper end of groove 46 corresponding to the end of upward travel of the support slide 16 connected with the long-hair trimmer 8. In other embodiments, instead of providing the rib 45 on the pawl 36, it also possible to provide the groove there, and instead of providing the groove 46 on the backing plate 19 it is also possible to provide the rib there in order to obtain the same effect of a coulisse guideway.

Furthermore, in FIGS. 2 to 5, a bolt 47 is fastened to the backing plate 19 below the center of rotation 37. The bolt 47 serves as pivot point for another lever 48. The upper free end of lever 48 terminates with a tooth 49 engaging from below within a toothed strip 50 provided on the support slide 16, however only in the positions according to FIGS. 2 to 4. The teeth formed on the toothed strip 50 are directed downwardly. Upon meshing engagement of the tooth 49 with the toothed strip 50, the support slide 16 of FIG. 2 can be displaced upwardly, but not downwardly in the direction X. For engagement of the lever 48 with the teeth 50, an extension spring 52 acts against the end 51 opposite the tooth 49 and takes support upon a pin 53 secured to the backing plate 19. The extension spring 52 is held biased between the pin 53 and the free end 51 of the lever 48 for resilient engagement with the toothed strip 50. The lever 48 combines with the toothed strip 50 to form the second ratchet-and-pawl mechanism 54, as mentioned above.

On the right-hand side of FIGS. 2 to 5, a tandem lever 57 having an upper and a lower control element 58, 59 is fastened to the backing plate 19 for pivotal movement about a center of rotation 56. The upper control element 58 rests against an intermediate member 60, which rests with its opposite end against an abutment surface 61 provided on the pawl 36 (FIG. 3). The intermediate member 60 is guided in a horizontal well 62 formed in the backing plate 19. Acting against the intermediate member 60 is a spring 63 bearing with its other end against the backing plate 19. The spring 63 serves to return the tandem lever 57 to its initial position shown in FIG. 2 following its actuation according to FIG. 3.

Figure 4:
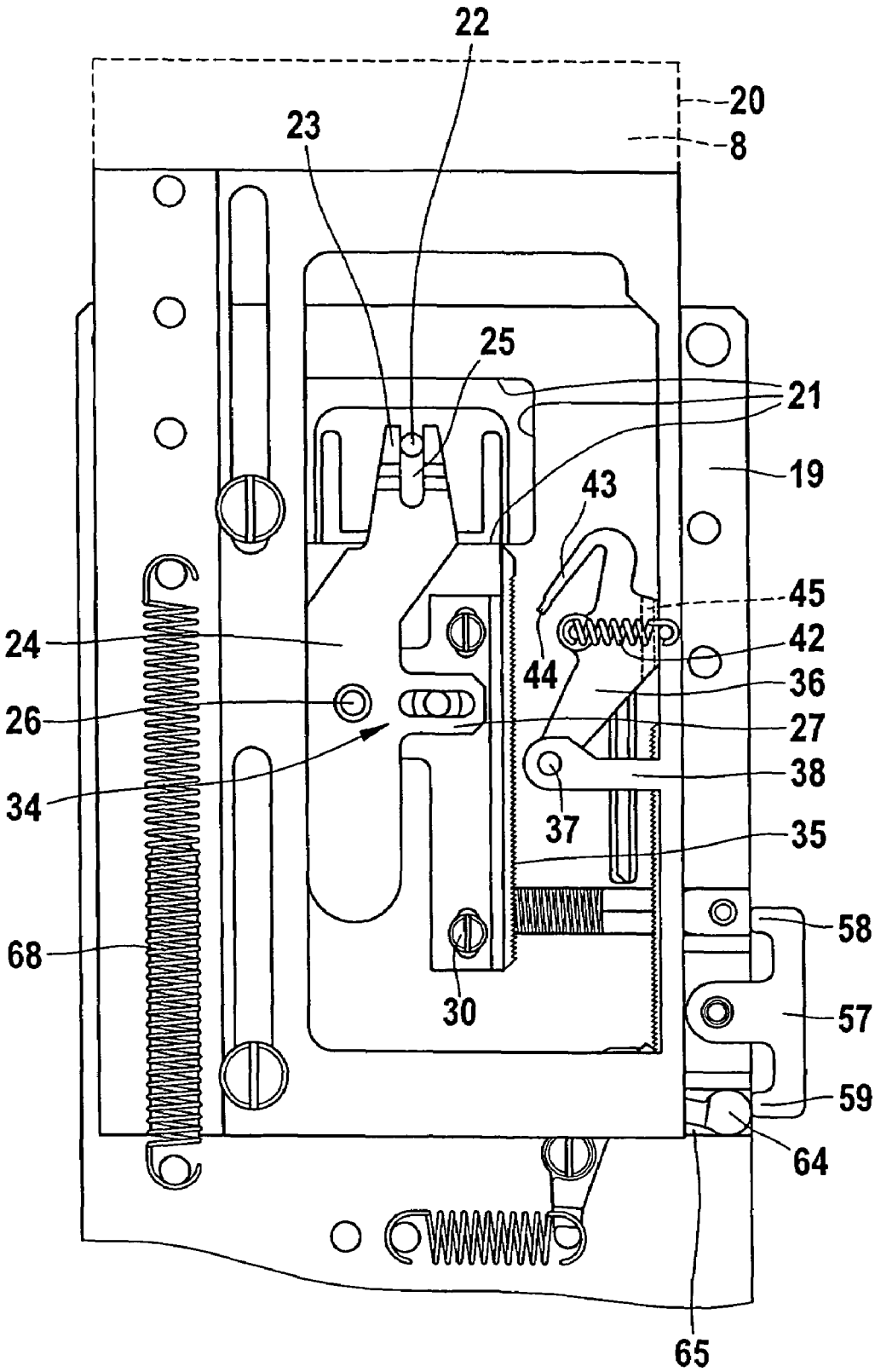
FIG. 4 is a view of the mechanical actuating device for the long-hair trimmer of FIG. 2, showing the long-hair trimmer in its maximum advanced position in which the first ratchet-and-pawl mechanism is again unlatched.

According to FIGS. 2 and 4 the lower control element 59 acts upon an intermediate member 64, which is likewise horizontally guided in a well 65 formed in the backing plate 19 and whose end remote from the lower control element 59 is pivotally connected to the lever 48 through a pivot joint 66. Upon actuation of the tandem lever 57 in clockwise direction according to FIG. 5, the lever 48 is turned counter-clockwise until its tooth 49 formed at its free end is disengaged from the teeth of the toothed strip 50. As this occurs, the spring 52 is further biased.

The mode of operation of the automatic pop-up device for use in the shaving apparatus is as follows:

Starting from the home position of FIG. 2, when wishing to cut off longer hairs, for example, beard hairs, the first step is to actuate an ON/OFF switch (not shown) provided on the shaving apparatus to start its electric motor (not shown). Then, the tandem lever 57 can be actuated by pivoting it about its center of rotation 56 to cause the long-hair trimmer 8 to move out of the housing 2 automatically. Starting the electric motor sets the drive part 22 in an oscillatory motion in accordance with the direction of displacement Y. The amount of excursion of the drive part 22 to the left and likewise to the right depends on the design of the gearing (not shown) provided between the electric motor and the drive part 22 or on the excursion of the oscillating armature motor.

In executing the oscillatory motion in the direction Y, the drive part 22 takes along the claw coupling 23 such that the bell crank lever 24 swings forward and backward about the journal 26 using a swinging motion X'. Simultaneously with the swinging motion X', the angle member 27 moves also, taking along the driving element 29 of the strip 31 correspondingly. As this occurs, the strip 31 is caused to oscillate only in the direction X upwards and downwards because, by virtue of the longitudinal bore 28, motions are transmitted to the strip 31 only in vertical and not in horizontal direction according to FIG. 2, hence producing a pure up-and-down motion in the direction X, which is transmitted via the driving element 29 to the strip 31. A contributing factor is also the coulisse guideway 33, which permits only a movement of the strip 31 in the direction X.

The connection between the drive part 22 for the long-hair trimmer 8 and the electric motor is established through a coupling member (not shown) when the tandem lever 57 is actuated, causing the long-hair trimmer 8 to be moved upwards in the direction X a small amount. This serves to prevent the long-hair trimmer from constantly running along with the short-hair cutter during a normal shaving operation which, apart from louder noise and increased energy consumption of the shaving apparatus, would necessarily subject the long-hair trimmer 8 to faster wear.

When it is desired to activate the long-hair trimmer 8 in addition to the short-hair cutter 11, an operator (not shown) moves with his finger 67 the upper control element 58 of the tandem lever 57 in accordance with FIG. 3, such as to cause the control element 58 to displace the intermediate member 60 to the left into the well 62. As a result, the pawl 36 is rotated counter- clockwise about the center of rotation 37 against the force of the spring 42. The free end 44 of the pawl 36 then meshes with the toothed construction 32, as shown in FIG. 3. Since the strip 31 moves up and down in the direction X, it is only during the upward movement that the pawl 36, and with it the support slide 16 with the long-hair trimmer 8, is moved upwardly by the resilient meshing engagement. As the tooth 49 of the lever 48 is in direct meshing engagement with the toothed strip 50 only when the strip 31 moves upwardly, the downward movement of the strip 31 causes the tooth 44 to slide over one or more teeth 35 of the toothed construction 32, and this is so because the meshing engagement is of the ratchet type and because during the downward movement the second ratchet-and-pawl mechanism 54 inhibits a displacement of the support slide 16 in downward direction.

On initial displacement of the support slide 16 upwards in the direction X, the rib 45 is aligned with the groove 46 as a result of the actuated position of the tandem lever 57 and the resulting counter-clockwise rotation of the pawl 36 into its engaged position of FIG. 3. Upon further displacement, the rib 45 engages within the groove 46, causing the pawl 36 to dwell in the position shown in FIG. 3 to thereby ensure meshing engagement of the free end 44 of the pawl 36 with the toothed construction 35 without the need for continued operation of the tandem lever 57. Therefore, with the long-hair trimmer 8 continuing to move upwardly, actuation of the tandem lever 57 can be terminated, so that it returns automatically to its initial position shown in FIG. 2, without the pawl 36 sliding out of the groove-and-rib arrangement 46, 45 again.

Each upward movement X of the strip 31 is followed by the downward return movement X, the free end 44 then sliding over one or several teeth 35 ratchet-like, because at the same time the second ratchet-and-pawl mechanism 54 prevents movement of the support slide 16 downward in the direction X. In the return stroke of the strip 31 the support slide 16 and hence the long-hair trimmer 8 dwell in this position. Upon the next upward stroke of the strip 31, the process previously described is repeated.

The long-hair trimmer 8 is not activated until it has been moved upward a small amount in the direction X or at the latest before it has reached its maximum advanced position, and it remains activated until it has reached its home position of FIG. 2 again. Responsible for the oscillatory shearing motion is a sliding coupling member (not shown) which does not engage the drive part 22 until the long-hair trimmer 8 has left its home position for a greater or lesser length of its travel. In this manner, the support slide 16, and with it the long-hair trimmer 8, travels stepwise in accordance with the oscillatory motion up to the trimmer's upper maximum position without the need to perform this displacement manually. Giving the tandem lever an initial push is sufficient to cause the long-hair trimmer 8 to travel out of its shaver housing 2 automatically in the upward direction X.

In this condition, longer hairs, or sideburns, or a beard or other hairs can be cut without the need to further actuate or hold the long-hair trimmer 8 in position. The reason for this is that the second ratchet-and-pawl mechanism 54 retains the long-hair trimmer 8 in its maximum advanced position.

Figure 5:
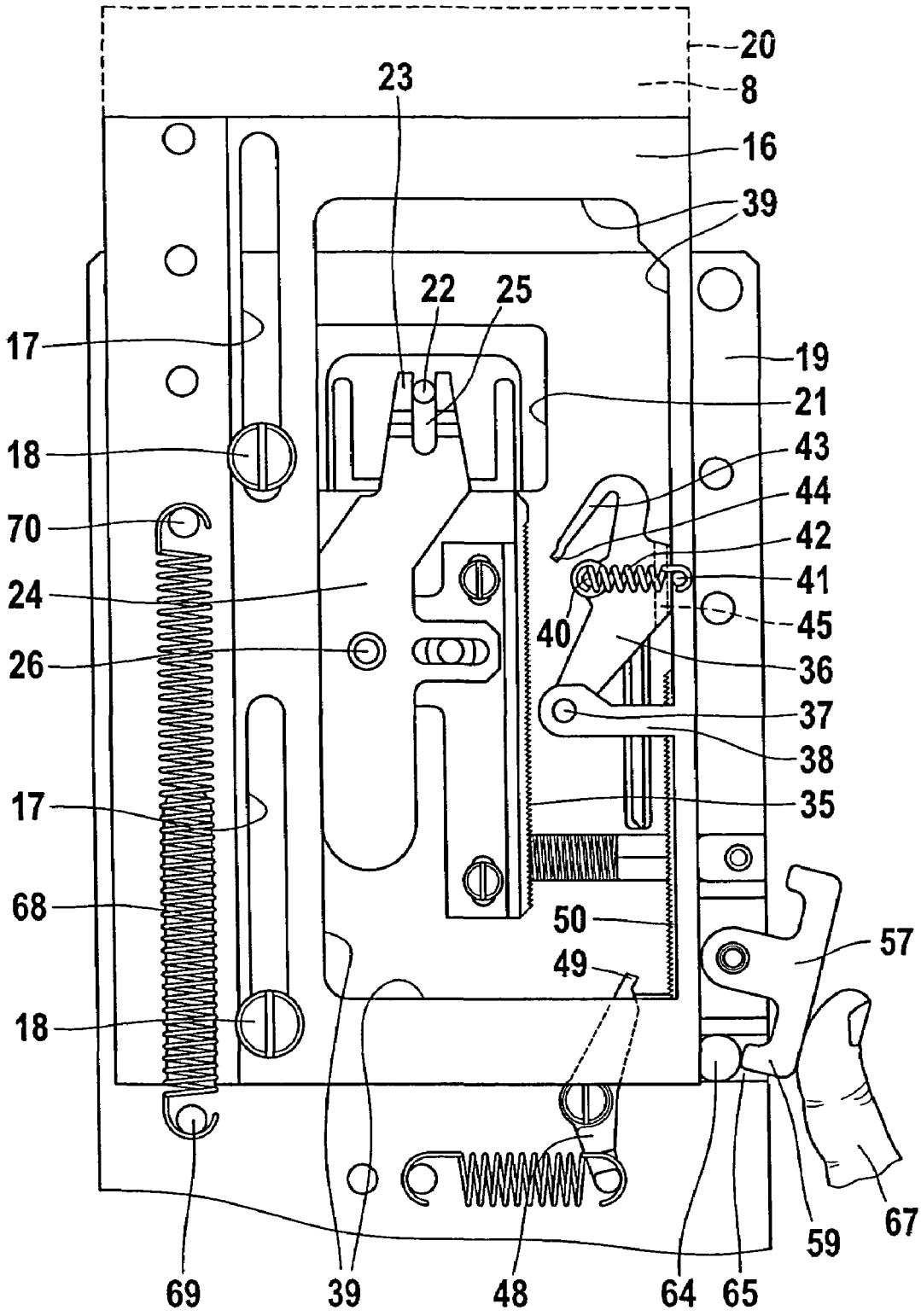
FIG. 5 is a view of the long-hair trimmer in its maximum advanced position shown in FIG. 4, showing the second ratchet-and-pawl mechanism brought into its disengaged position manually by means of the tandem lever in order to enable the long-hair trimmer to return automatically to its home position by means of a spring when trimming is completed.

To terminate a long-hair trimming operation, an operator presses with his finger 67 down on the lower control element 59 of the tandem lever 57 as shown in FIG. 5, such that its end moves the intermediate member 64 to the left within the well 65, thereby causing the lever 48 to be rotated counter-clockwise. As this occurs, the tooth 49 formed at the lever's free end moves away from the toothed strip 50, thereby unlatching the second ratchet-and-pawl mechanism 54. As shown in FIG. 5, by virtue of the biased extension spring 68 which has its one end mounted on the backing plate 19 through a bolt 69, and its other end on the support slide 16 through a bolt 70, the support slide is displaced downwards in the direction X, returning to its home position. In the process, the longitudinal slots 17 slide along the guide pins 18, whereby the direction of displacement X of the support slide 16 is exactly maintained. To avoid canting of the support slide 16, another guide device (not shown) may be provided on the right-hand side. Following its release, the tandem lever 57 returns to its initial position shown in FIG. 2. The lever 48 follows this movement, that is, it resumes the engaged position shown in FIG. 2 because the extension spring 52 always biases the lever 48 clockwise.

A number of embodiments of the invention have been described. Nevertheless, it will be understood that various modifications may be made without departing from the spirit and scope of the invention. Accordingly, other embodiments are within the scope of the following claims.

What is claimed is:

1. An electric-powered shaving apparatus comprising:

a housing;

an electric motor;

a short hair cutter;

a long hair trimmer;

a drive part excitable by the electric motor into performing an oscillatory motion, the drive part transmitting its motion for cutting hairs to the short-hair cutter and to the long-hair trimmer, the long-hair trimmer being displaceable relative to the housing into an advanced and a retracted position, wherein the motion of the drive part moves the long-hair trimmer into the advanced position; and a motion-converting mechanism between the drive part and the long-hair trimmer to divert the oscillatory motion into a direction of displacement of the long-hair trimmer, to move the long hair trimmer into the advanced position.

2. The shaving apparatus according to claim 1, further comprising:

a strip movable in the direction of displacement at the output of the motion converting mechanism;

a first ratchet-and-pawl mechanism between the strip and the long-hair trimmer, the first ratchet-and-pawl mechanism comprising;

a movable pawl on the long-hair trimmer; and a toothed construction on the strip, the toothed construction being movable into meshing engagement with the pawl for advancing the long-hair trimmer.

3. The shaving apparatus according to claim 2, further comprising a retaining device that permits release of the first ratchet-and-pawl mechanism only when the long-hair trimmer is in the maximum advanced position, following latching engagement of the pawl with the toothed construction.

4. The shaving apparatus according to claim 3, wherein the retaining device comprises:

a spring element; and a groove provided in the housing along the direction of displacement for engagement with a rib provided on the pawl, the groove extending parallel to the direction of displacement and ending level with the maximum advanced position of the long-hair trimmer, the pawl being acted upon by the spring element in the direction of release.

5. The shaving apparatus according to claim 2, further comprising a second ratchet-and-pawl mechanism acting between the long-hair trimmer and the housing of the shaving apparatus, and inhibiting displacement of the long-hair trimmer toward the retracted position.

6. The shaving apparatus according to claim 5, wherein the second ratchet-and-pawl mechanism comprises:

a longitudinal toothed construction provided on the long-hair trimmer; and a lever fastened to the housing and resiliently engaging in the longitudinal toothed construction.

7. The shaving apparatus according to claim 6, further comprising a spring element, biasing the long-hair trimmer toward the retracted position.

8. The shaving apparatus according to claim 5, further comprising a control element, such that the first and the second ratchet-and-pawl mechanisms are adapted to latch and unlatch manually by means of the control element.

* * * * *

UNITED STATES PATENT AND TRADEMARK OFFICE

CERTIFICATE OF CORRECTION

PATENT NO. : 7,490,408 B2
APPLICATION NO. : 11/639648
DATED : February 17, 2009
INVENTOR(S) : Reinhold Eichhorn et al.

It is certified that error appears in the above-identified patent and that said Letters Patent is hereby corrected as shown below:

Cover page, item [73], Assignee:

Delete “Krongberg” and Insert --Kronberg--

Signed and Sealed this

Twenty-first Day of April, 2009

JOHN DOLL
*Acting Director of the United States Patent and Trademark Office*